US008379040B2

(12) United States Patent
Mori

(10) Patent No.: US 8,379,040 B2
(45) Date of Patent: Feb. 19, 2013

(54) PICTURE PROCESSING METHOD AND MOBILE COMMUNICATION TERMINAL

(75) Inventor: Hirofumi Mori, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 830 days.

(21) Appl. No.: 12/536,174

(22) Filed: Aug. 5, 2009

(65) Prior Publication Data

US 2010/0194769 A1 Aug. 5, 2010

(30) Foreign Application Priority Data

Aug. 5, 2008 (JP) ..... 2008-202070

(51) Int. Cl.
*G09G 5/02* (2006.01)

(52) U.S. Cl. ..... 345/589

(58) Field of Classification Search ..... 345/589–605
See application file for complete search history.

(56) References Cited

U.S. PATENT DOCUMENTS

| | | | | |
|---|---|---|---|---|
| 6,677,992 | B1 * | 1/2004 | Matsumoto et al. | 348/229.1 |
| 6,728,401 | B1 * | 4/2004 | Hardeberg | 382/167 |
| 7,220,006 | B2 * | 5/2007 | Allen et al. | 353/85 |
| 7,839,455 | B2 * | 11/2010 | Harada | 348/672 |
| 7,928,999 | B2 * | 4/2011 | Russell et al. | 345/690 |
| 7,973,973 | B2 * | 7/2011 | Nose et al. | 358/3.01 |
| 2003/0189558 | A1 * | 10/2003 | Aoki et al. | 345/204 |
| 2006/0098077 | A1 | 5/2006 | Dowling | |
| 2007/0126672 | A1 | 6/2007 | Tada et al. | |
| 2007/0139406 | A1 | 6/2007 | Ozawa et al. | |
| 2007/0139437 | A1 | 6/2007 | Boroson et al. | |
| 2007/0265031 | A1 * | 11/2007 | Koizumi et al. | 455/556.1 |

FOREIGN PATENT DOCUMENTS

| | | |
|---|---|---|
| JP | 2001-230941 | 8/2001 |
| JP | 2004-266755 | 9/2004 |
| JP | 2004-326082 | 11/2004 |
| JP | 2006-295845 | 10/2006 |
| JP | 2006-311179 | 11/2006 |
| JP | 2007-41535 | 2/2007 |
| JP | 2007-147730 | 6/2007 |
| JP | 2007-248936 | 9/2007 |
| JP | 2007-298693 | 11/2007 |
| JP | 2008-107719 | 5/2008 |
| JP | 2008-139840 | 6/2008 |
| JP | 2008-139842 | 6/2008 |

OTHER PUBLICATIONS

Office Action issued Jul. 26, 2011 in Japan Application No. 2008-202070 (With English Translation).

Kenji Akiyama, et al., "W65T CDMA2000 1x Cellular Phone with Improved Usability and Functions", Toshiba Review, Toshiba Corporation, vol. 64, No. 2, Feb. 1, 2009, pp. 39-42 (With English Abstract).

U.S. Appl. No. 12/326,188, filed Dec. 2, 2008, Mori.

* cited by examiner

*Primary Examiner* — Xiao M. Wu
*Assistant Examiner* — Charles Tseng
(74) *Attorney, Agent, or Firm* — Oblon, Spivak, McClelland, Maier & Neustadt, L.L.P.

(57) ABSTRACT

A picture processing method and apparatus in which an APL (average picture level) value is calculated from luminance signals, weighting coefficients are obtained according to chrominance signals, and a number of pixels contained in a picture frame, and a peak luminance is obtained based on the APL value. Subsequently, the picture frame is displayed on a display panel within a limitation of the peak luminance.

12 Claims, 6 Drawing Sheets

PICTURE PROCESSING METHOD AND MOBILE COMMUNICATION TERMINAL

CROSS-REFERENCE TO RELATED APPLICATIONS

This application is based upon and claims the benefit of priority from prior Japanese Patent Application No. 2008-202070, filed Aug. 5, 2008, the entire contents of which are incorporated herein by reference.

BACKGROUND OF THE INVENTION

1. Field of the Invention

The present invention relates to a picture processing method and a mobile communication terminal equipped with a display module such as a PDP (Plasma Display Panel) or an OLED (Organic Light Emitting Diode) panel.

2. Description of the Related Art

It is known that power consumption varies according to a displayed scene in a self-luminous display panel such as the PDP and the OLED panel, and there is a method to cut electric power consumption by controlling peak brightness according to the displayed scene. For example, Jpn. Pat. Appln. KOKAI Publication No. 2007-147868 (Tada et al.) discloses that a base peak luminance value is adjusted so that electric power consumption is kept below a predetermined consumption of electrical energy for each base period. Concretely, for each picture frame, the peak luminance ratio is obtained according to an average gradation value of a picture frame and a norm peak luminance value is calculated by multiplying the base peak luminance value by the peak luminance ratio. Thereafter, the norm peak luminance is adjusted if the electric power consumption, which is calculated by multiplying the average gradation value by the norm peak luminance value, exceeds the predetermined electrical energy consumption for each base period.

Also, Jpn. Pat. Appln. KOKAI Publication No. 2004-266755 (Fujishima) discloses that correction intensity is obtained based on an index value calculated from averaged luminance signals of two consecutive frames and a Gamma correction function is obtained according to the correction intensity. Thereafter, luminance correction is executed based on the Gamma correction function.

BRIEF SUMMARY OF THE INVENTION

However, the present inventors recognized these publications do not consider colorfulness when correcting luminance signal, and therefore, brightness varies unnaturally. Especially, JP 2004-266755 (Fujishima) is silent about electric power consumption.

Exemplary embodiments of the present invention provide a picture processing method which enables to cut power consumption without degrading picture quality of a sense of brightness.

A picture processing method includes: receiving picture data including a luminance signal and chrominance signals for each pixel of a picture frame; calculating a saturation value based on the chrominance signals; obtaining a weight coefficient corresponding to the saturation value by referring to a weight coefficient storage; calculating a first value by multiplying the luminance signal by the weight coefficient for the each pixel; accumulating the first values for the each pixels; calculating a picture level value of the picture frame by dividing the accumulated first values by the number of pixels contained in the picture frame; obtaining a peak luminance corresponding to the picture level value by referring to a gain storage area; and converting the luminance signal included in the picture data based on the obtained peak luminance.

BRIEF DESCRIPTION OF THE SEVERAL VIEWS OF THE DRAWINGS

The accompanying drawings, which are incorporated in and constitute a part of the specification, illustrate exemplary embodiments of the invention, and together with the general description given above and the detailed description of the exemplary embodiments given below, serve to explain the principles of the invention. In the drawings.

DETAILED DESCRIPTION OF EXEMPLARY EMBODIMENTS OF THE INVENTION

Exemplary embodiments of the present invention will be described hereinafter with reference to the accompanying drawings.

Figure 1:
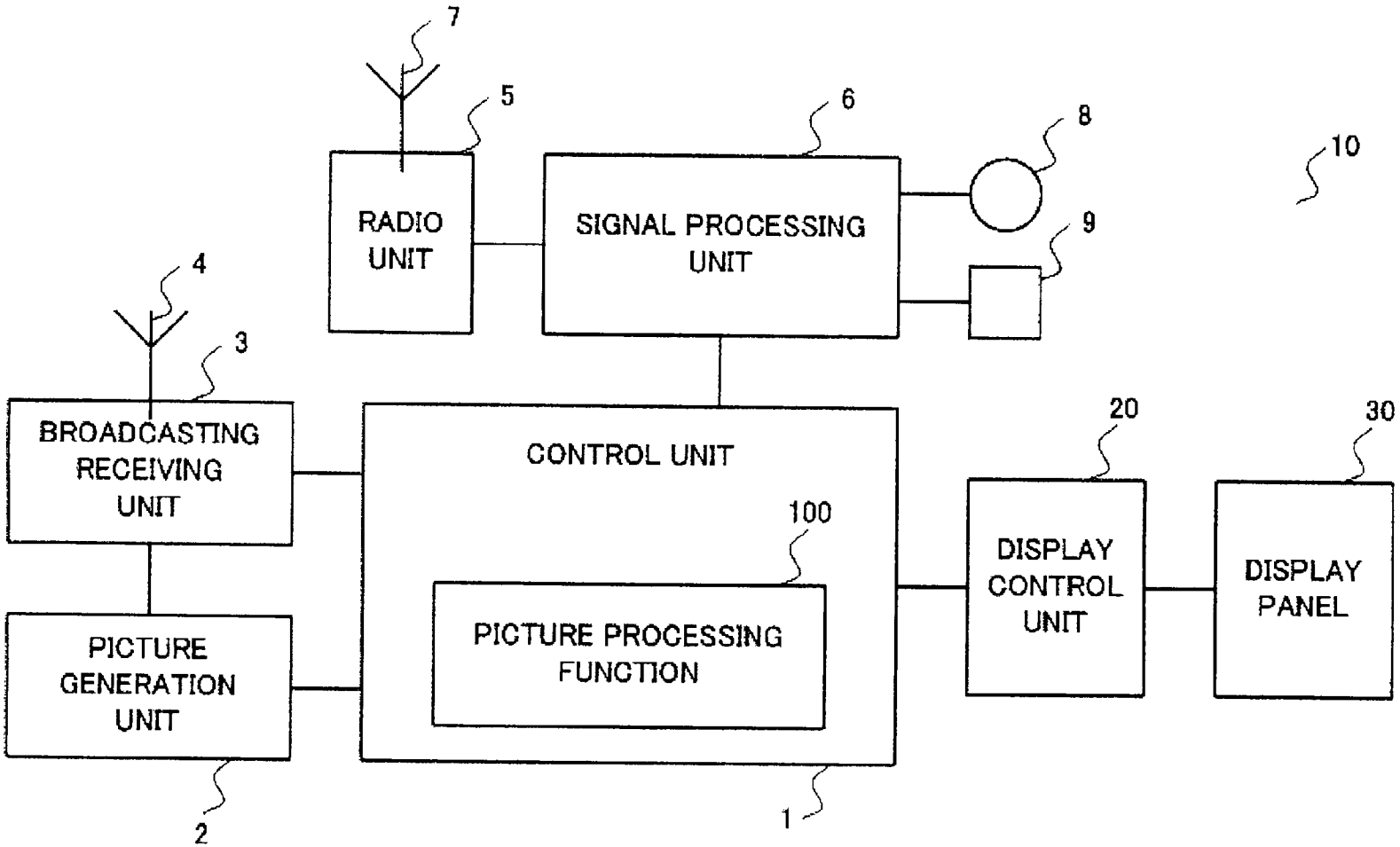
FIG. 1 is a block diagram showing an arrangement of a cellular phone of an embodiment of the invention.

FIG. 1 shows an exemplary arrangement of a cellular phone 10 which is equipped with a picture processing apparatus according to the embodiment. The cellular phone 10 includes a control unit 1 that controls various sorts of operations of the cellular phone 10, a picture generation unit 2 that decodes coded moving picture data, a digital terrestrial broadcasting receiving unit 3 that, via an antenna 4, receives broadcasting signal contained in a channel identified by the control unit 1 and extracts TS (Transport Stream) packets by demodulating the received broadcasting signal, a radio unit 5 that obtains a baseband signal by demodulating radio signals received by the antenna 5 from a base station, a signal processing unit 6 that obtains speech signals, control signals, and data signals by decoding the baseband signal according to the CDMA method, and further encodes speech signals, control signals, and data signals to be transmitted via the antenna 7, a microphone 8 that captures a voice, a speaker 9 that outputs the speech signal from the signal processing unit 6, and a display control unit 20 that controls a display panel 30 so that a picture signal is displayed on the display panel 30.

The picture processing apparatus in the cellular phone 10 corresponds to a picture processing function 100 in FIG. 1, which is part of the control unit 1, as main functions of picture processing are realized by a combination of hardware and software, e.g. a firmware, in the control unit 1 in this embodiment.

Figure 2:
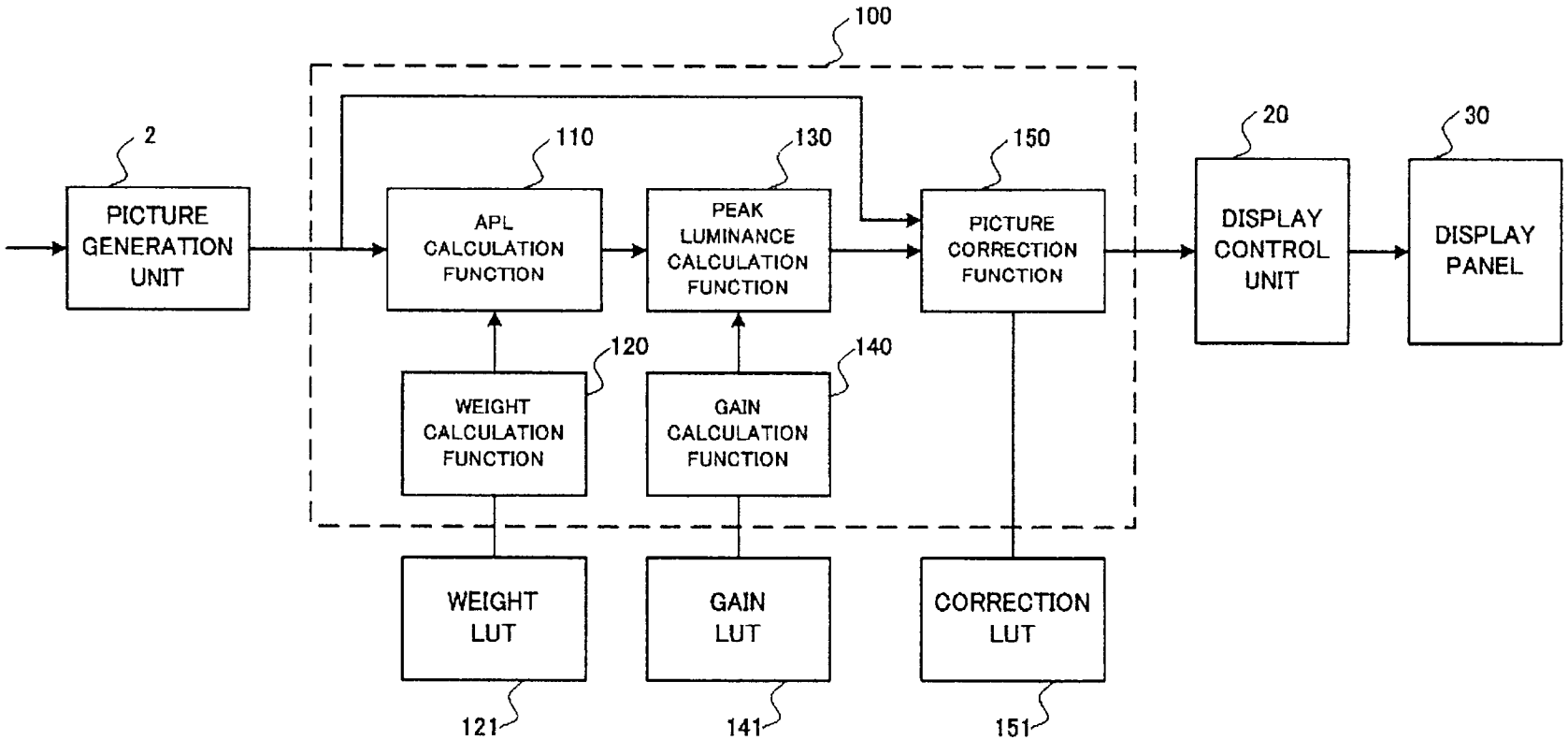
FIG. 2 is a block diagram showing an arrangement of a picture processing function executed by the cellular phone shown in FIG. 1.

FIG. 2 is a functional block diagram showing detailed processing executed by the picture processing function 100.

As a human visual feature, there is a well-known feature known as the Helmholtz-Kohlrausch effect. This feature indicates that images are perceived to be brighter as the saturation increases in the images even though the brightness does not change. Namely, a colorful image is perceived to be brighter than an achromatic image by people even though both images have the same luminance level.

Consequently, in this embodiment, when an APL (average picture level) value indicates a picture frame is colorful, a permissible luminance level for the picture frame is controlled not to use a given number of luminance levels within the highest luminance level. In this case, since relatively lower luminance levels are used, power consumption can be reduced; however, since the image is colorful the image will still be perceived by a human user to have adequate brightness. On the other hand, when an APL value indicates a picture frame is achromatic, the highest luminance levels or almost the highest luminance levels are used for displaying the monochrome picture frame, so that picture frame is still perceived by a human operator as adequately bright.

The picture processing function 100 includes an APL calculation function 110, a weight calculation function 120, a peak luminance calculation function 130, a gain calculation function 140, and a picture correction function 150.

The picture generation unit 2 decodes a coded bit stream such as a video elementary stream that is demultiplexed from a multiplexed stream contained in the TS (transport stream) packets at a multiplexed stream demultiplexer (not shown) located between the digital terrestrial broadcasting receiving unit 3 and the picture generation unit 2, and generates luminance signal Y and chrominance signals U and V as picture data for each pixel of a picture frame. The multiplexed stream can be a stream contained in a data file downloaded from a server.

The APL calculation function 110, via the weight calculation function 120, refers to a weight look-up table (LUT) 121 in a storage area managed by the weight calculation function 120 and obtains a weight coefficient according to the chrominance signals U and V output from the picture generation unit 2. Thereafter, the APL calculation function 110 weights the luminance signal Y with the extracted weight coefficient and calculates an APL value for the picture frame.

The weight LUT 121, for example, is a table storing a relationship between the chrominance signals (U and V) and corresponding weight coefficients W(U,V). Namely, the table shows the relationship between color phase and saturation. In this embodiment, so as not to degrade picture quality, the weight coefficient decreases as the chrominance signal indicates more sensitivity to change of luminance. For example, when displaying an achromatic picture frame, perceived brightness of the displayed picture frame becomes darker as a luminance level becomes lower; therefore, a smaller weight coefficient is assigned to the achromatic picture frame.

For this reason, the APL calculation function 110, by weighting, reduces an APL value calculated from an achromatic picture frame, which is composed of relatively achromatic pixels, more than an APL value calculated from a colorful picture frame, which is composed of relatively colorful pixels.

Hereinafter, how to set the weight coefficients W (U,V) is explained.

Figure 3A:
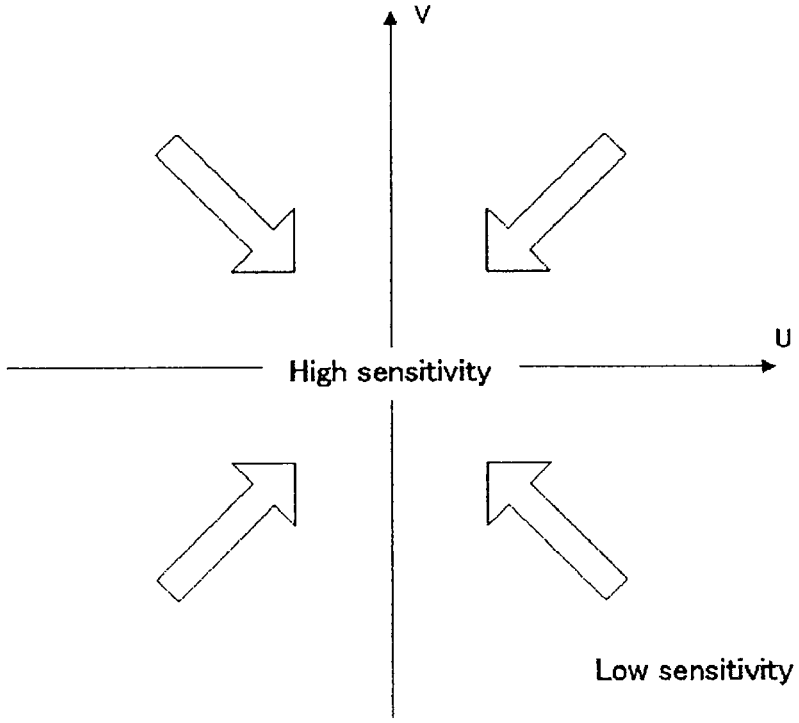
FIG. 3 is a diagram for explaining a characteristic of a weight LUT (Look-up table) which is referred to by a weight calculation function shown in FIG. 2.

FIG. 3A shows a relationship between values of chrominance signals (U and V) and saturation, and four arrows indicate increasing amounts of the saturation. Accordingly, in this example, the weight coefficient takes a higher value as the saturation increases and goes to the coordinate center.

Concretely, the weight coefficient W(U,V) is calculated based on the following function $W_s(u,v)$.

$$\text{Saturation}=\text{squr}(u^2+v^2)$$

$$\text{if) Saturation}<TH_s$$

$$W_s(u,v)=a(\text{Saturation})+b$$

$$\text{else)}$$

$$W_s(u,v)=1$$

$$TH_s=64$$

wherein, a is a gradient, b is a weight coefficient for the purely achromatic color, and $TH_s$ is a threshold. The weight coefficient b and the threshold $TH_s$ are determined in accordance with an experimental rule. The gradient a is calculated if the weight coefficient b and the threshold $TH_s$ are determined since two coordinates of a linear function are specified.

Figure 3B:
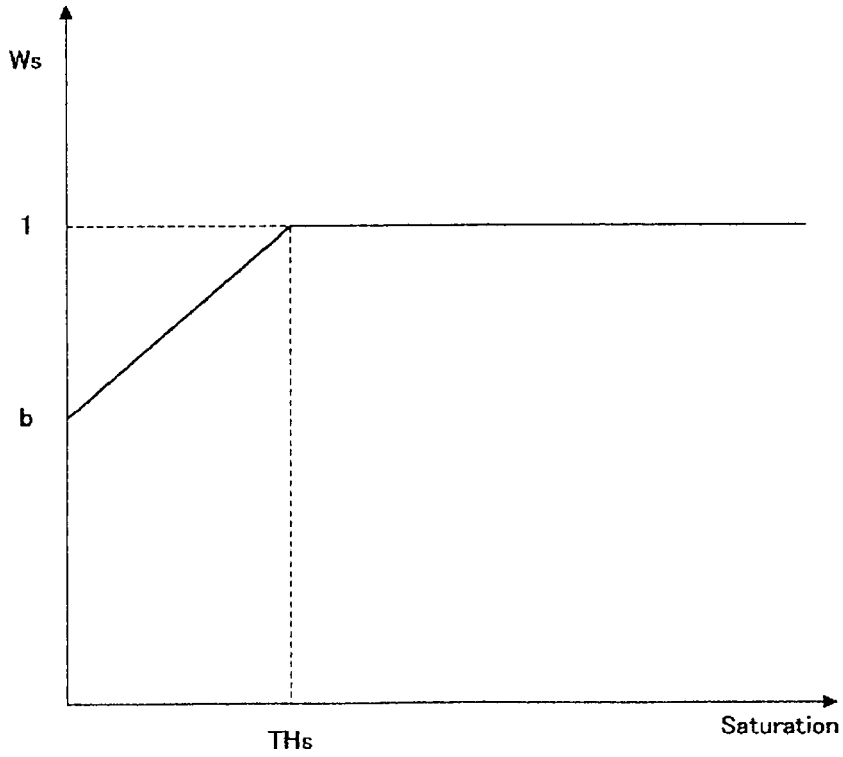

Namely, as shown in FIG. 3B, the function $W_s(u,v)$ linearly varies when the saturation is less than the threshold $TH_s$. Also, the function $W_s(u,v)$ is 1 (fixed value) when the saturation is greater than or equal to the threshold $TH_s$. However, the function $W_s(u,v)$ is not limited to the characteristics above. The function $W_s(u,v)$ can be expressed by a Gauss function. For example, an arbitrary monotonic increasing part of the Gauss function may be applied to the function $W_s(u,v)$ whose x-coordinate is 0 through $TH_s$. Also, the function $W_s(u,v)$ can include a plurality of break points by setting at least two threshold values.

By setting the weighting feature according to the saturation into the weight LUT 121, as described above, the APL value of a colorful picture frame, e.g. a frame of a moving picture, calculated by the APL calculation function 110 relatively gets higher than the APL value of an achromatic picture frame. Subsequently, peak luminance Y-peak (maximum luminance level) becomes lower for the colorful picture frame, and thereby power consumption is lowered.

Figure 4A:
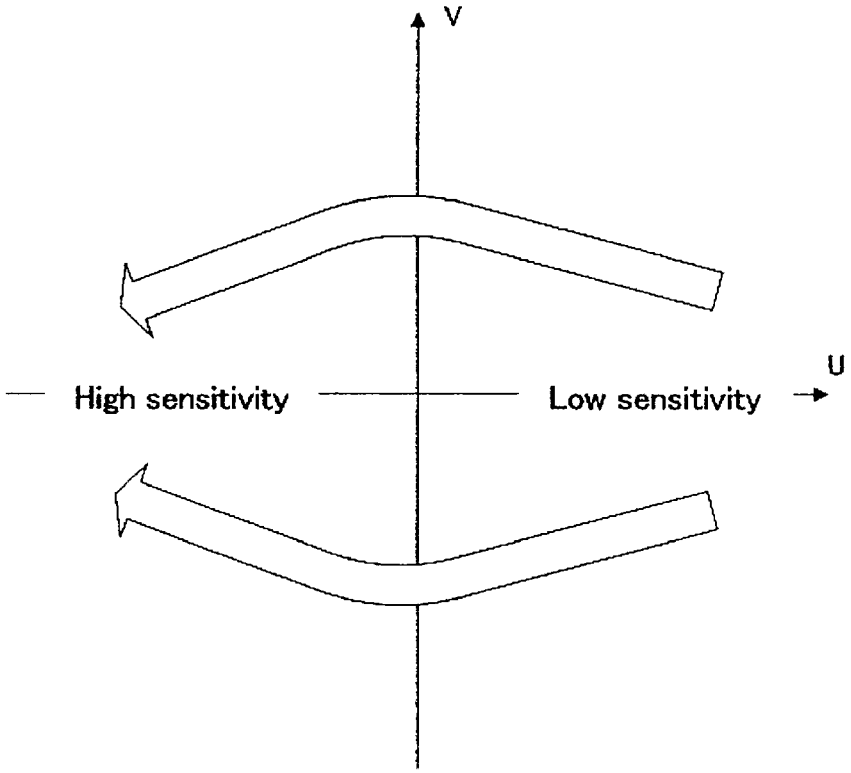
FIG. 4 is a diagram for explaining another characteristic of a weight LUT which is referred to by the weight calculation function.

From the Helmholtz-Kohlrausch effect it is also known to vary perceived brightness according to color phase. For example, as for a yellow color, a sense of brightness is flat even if the saturation varies. However, as fora color phase of a short-wavelength color such as blue or purple, or a color phase of a long-wavelength color such red, the perceived sense of brightness increases as the saturation increases; therefore, as shown in FIG. 4A, the weight LUT 121 can store a weight feature that the weight coefficient on the luminance decreases as the color phase θ goes to yellow. Two arrows in FIG. 4A indicate increase directions of the weight level.

Concretely, the weight coefficient W(U,V) is calculated based on the following function $W_\theta(u,v)$.

$$\text{if) } \theta<TH_\theta$$

$$W_\theta(u,v)=c(\pi-\theta)+d$$

$$\text{else)}$$

$$W_\theta(u,v)=c(\theta-\pi)+d$$

$$TH_\theta=\pi$$

wherein, c and d are constant values, and π is the circle ratio.

Figure 4B:
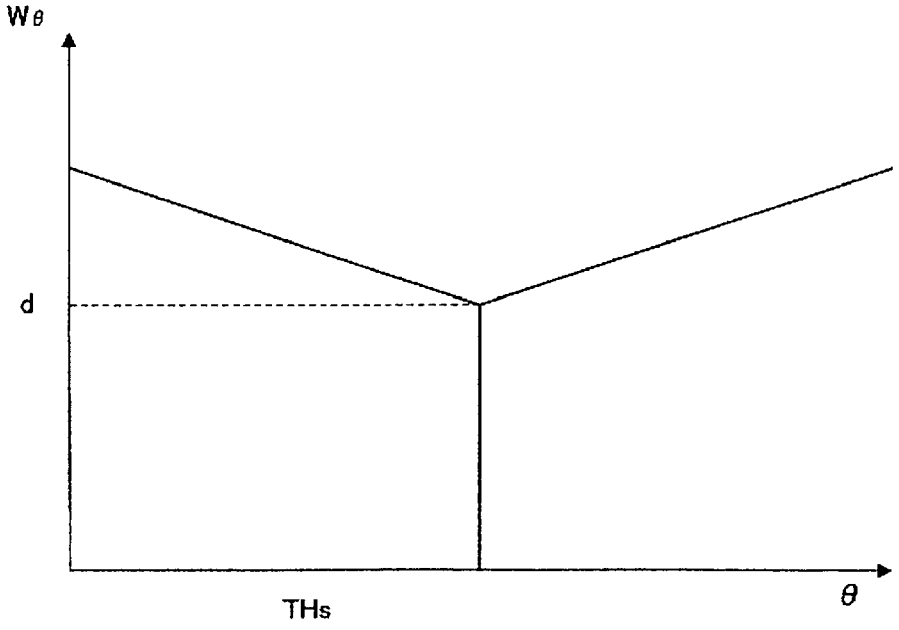

Namely, the weight feature as shown in FIG. 4B is set in the weight LUT 121. Also, in this case, the weight function $W_\theta(u,v)$ is not limited to be expressed by the polygonal line as shown in FIG. 4B, but can be expressed by the Gauss function.

Furthermore, the weight feature can be expressed by combining two weight features. For example, the weight feature defined by a following weight function W(u,v) can be set into the weight LUT 121.

$$W(u,v)=W_s(u,v)*W_\theta(u,v)$$

Now, returning to the explanation regarding FIG. 2, as described above, it is explained that the weight calculation function 120 manages the weight LUT 121 in the storage area; however, in place of the weight LUT 121, the weight calculation function 120 may calculate the weight coefficient based on a function modeled from the weight LUT 121. Then, the APL calculation function 110 calculates the APL value by weighting the luminance signal with a weight coefficient calculated based on the function in the storage area.

The peak luminance calculation function 130, via the gain calculation function 140, refers to a gain look-up table (LUT) 141 in a storage area managed by the gain calculation function 140, and determines a peak luminance corresponding to the APL received from the APL calculation function 110. Consequently, the peak luminance calculation function 130 determines the peak luminance suitable for displaying the picture frame.

Figure 5:
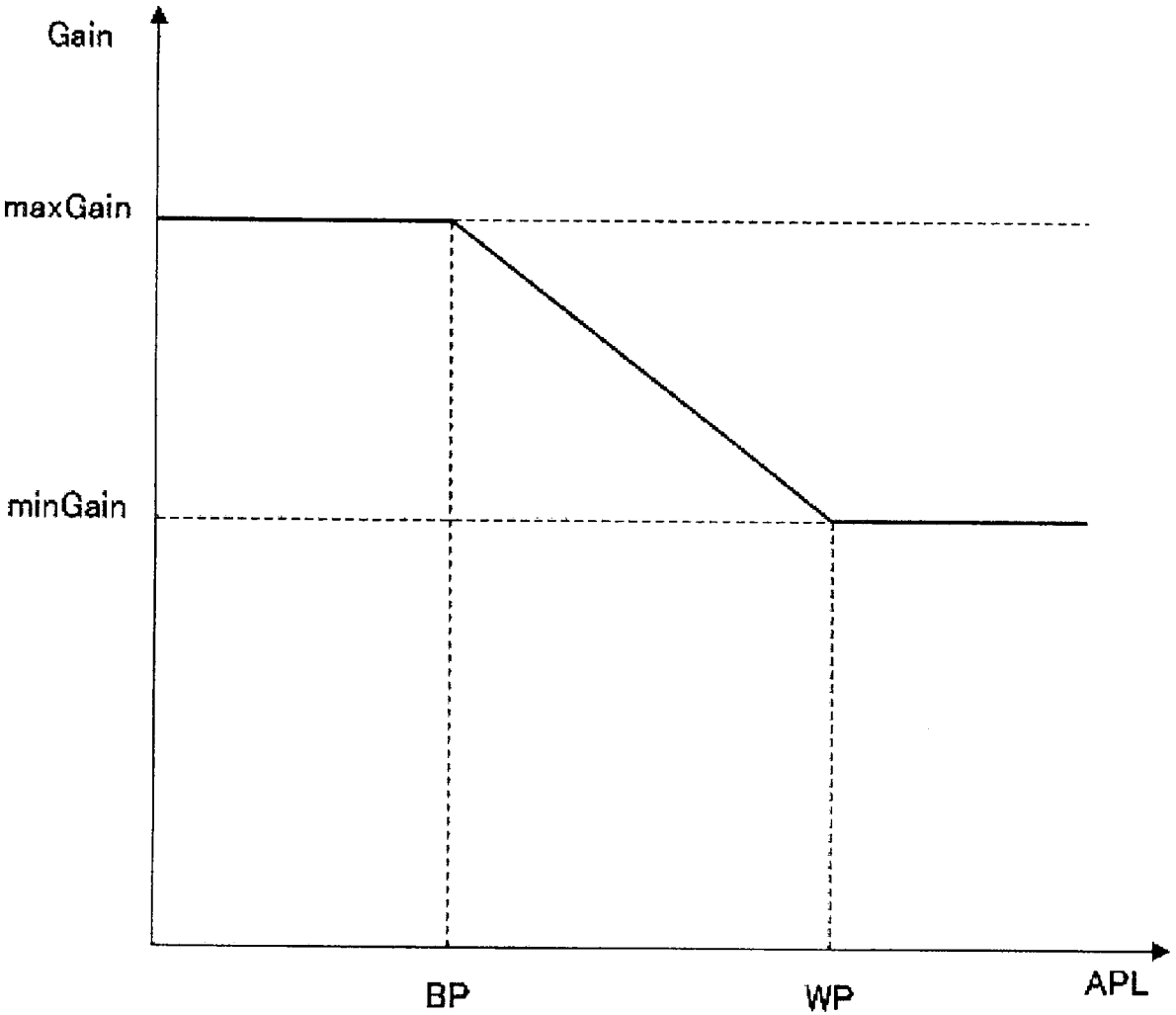
FIG. 5 is a diagram for explaining a characteristic of a LUT which is referred to by a gain calculation function.

The gain LUT 141 is a table defining a relationship between the APL value and the gain, and has a feature that the gain decreases as the APL value increases as shown in FIG. 5. In FIG. 5, the gain LUT 141 is expressed by the combination of linear functions; however, the gain LUT 141 can be expressed by the Gauss function as described above, and also can be realized by an operation according to a modeled function.

The picture correction function 150 of FIG. 2 generates a correction value of a luminance signal based on the peak luminance calculated by peak luminance calculation function 130, corrects the luminance signal Y of the picture data based on the generated correction value, and outputs the corrected luminance signal Y' together with the chrominance signals (U and V).

The display control unit 20 receives the picture data of the corrected luminance signal Y' and the chromatic signals (U and V) from the picture correction function 150, and, based on the corrected luminance signal Y' and chrominance signals (U and V), controls a self-luminous display panel such as an OLED panel or a PDP so as to display a picture such as a still image or a moving picture on the display panel 30.

Next, processing executed by the picture processing apparatus having the above functions is explained.

Figure 6:
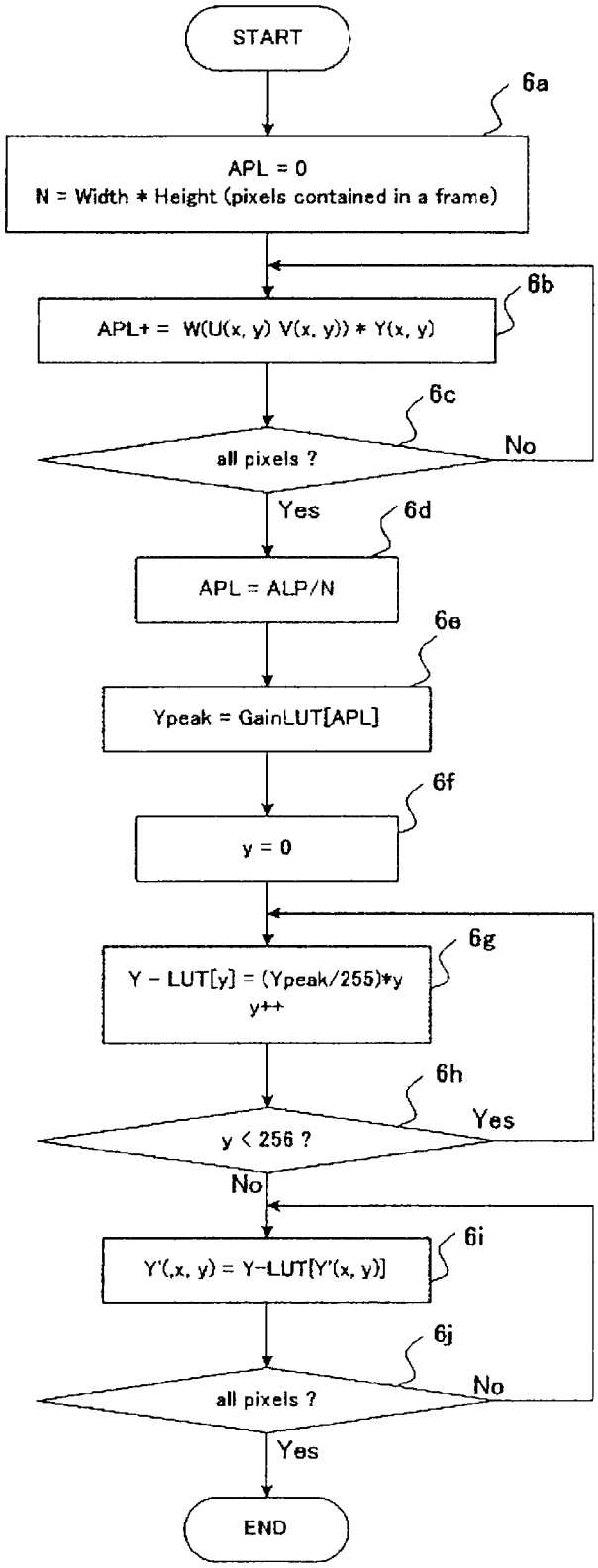
FIG. 6 is a flowchart for explaining an operation of the picture processing function shown in FIG. 2.

FIG. 6 is a flowchart showing the processing executed by the picture processing apparatus, in which the picture data obtained by the picture generation unit 2 is corrected as described above, and the picture processing apparatus executes the processing on a frame to frame basis.

The processing is explained with reference to FIG. 6.

In step 6*a*, the APL calculation function 110 first initializes apl and N, wherein apl is a variable to be used in a later processing and N is a variable indicating the number of pixels (the number of pixels on a row times the number of pixels on a column) contained in a picture frame, and goes to a step 6*b*. In this case, 0 is set to the variable apl as an initial value.

In step 6*b*, the APL calculation function 110 first selects one pixel designated by coordinate (x,y) on a picture frame to be processed. No same pixel is selected twice from one picture frame by the APL calculation function 110. Then, the APL calculation function 110, via the weight calculation function 120, obtains a weight coefficient W(U(x,y), V(x,y)) corresponding to chrominance signals U(x,y) and V(x,u) calculated from the pixel on the selected coordinate (x,y), and multiplies the luminance signal Y, corresponding to the coordinate (x,y), by the obtained weight coefficient. Subsequently, the APL calculation function 120 adds the result of the multiplication to the variable apl, and the processing goes to step 6*c*.

In step 6*c*, the APL calculation function 120 checks whether all multiplications for all pixels contained in the picture frame to be processed have been calculated. If the multiplications for all pixels have been executed, Yes in step 6*c*, the processing goes to step 6*d*, if not, if No in step 6*c*, the processing goes back to step 6*b* and the calculations for the remaining pixels are executed.

In step 6*d*, the APL calculation function 120 calculates an APL value by dividing the variable apl calculated at steps 6*b* and 6*c* by the variable N (N indicating the total number of pixels), and the processing goes to step 6*e*. Thus, the APL value for the frame to be processed is determined.

In step 6*e*, the peak luminance calculation function 130, via the gain calculation function 140, refers to the gain LUT 141 managed by the gain calculation function 140, and obtains a gain value GainLUT[APL] corresponding to the APL value calculated in step 6*d*. When the GainLUT[APL] is obtained, the peak luminance calculation function 130 determines the peak luminance Ypeak by multiplying the maximum luminance level of the display panel 30 by the obtained gain value GainLUT[APL], and the processing goes to step 6*f*. For example, when the luminance of the display panel 30 is represented by an 8 bit signal, the luminance can be represented by 256 levels. In this case, if the obtained gain value GainLUT [APL] is 0.9, a peak luminance Ypeak is 229. Therefore, luminance levels 0 (lowest luminance level) through 229 (highest luminance level) are used for displaying a corresponding frame. The maxGain and the MinGain in FIG. 5 is defined according to a criterion of 0<minGain<maxGain<1.

Subsequently, when a suitable peak luminance for the picture frame to be processed is determined, picture correction function 150 generates a correction look-up table (LUT) based on a reproducible range of the luminance signal and the peak luminance Ypeak. In this case, the reproducible range of the luminance signal is assumed to be 256 levels since the luminance signal is also represented by 8 bits, in this embodiment.

In step 6*f*, the picture correction function 150 initializes a counter value y identifying a luminance signal Y in the control unit 1.

As described above, the peak luminance Ypeak of a frame with high APL level is reduced a greater amount compared with that of a frame with a low APL value, and the picture frame with the smaller APL value is displayed on display panel 30 with a reproducible peak luminance Ypeak of the display panel 30. On the other hand, the picture frame with the higher APL value is displayed on the display panel 30 with the peak luminance Ypeak below the reproducible peak luminance of the display panel 30.

In step 6*g*, the picture correction function 150 generates a correction look-up table (LUT) 151 for luminance signals, Y=0 through Y=255 in the reproducible luminance range, based on the peak luminance Ypeak calculated in step 6*e*. The correction LUT 151 defines the relationship between the each luminance signal Y in the reproducible luminance range and the converted luminance signal Y-LUT [y]. First, the picture correction function 150 reads out the counter value y=0 from the counter and calculates Y-LUT[0] corresponding to 0. Thereafter, the picture correction function 150 increases the counter value y by 1. Subsequently, the picture correction function 150 reads out the counter value y=1 from the counter and calculates Y-LUT[1] corresponding to 1. The process in step 6*g* continues until the picture correction function 150 detects that the counter value y exceeds 255, in step 6*h*. For example, if the peak luminance Ypeak is 229, as is described above, the Y-LUT[0] is calculated by (229/255) *0 and the Y-LUT[0] corresponds to 0, the Y-LUT[1] is calculated by (229/255)*1 and the Y-LUT[1] corresponds to 0 because of half adjust, and the Y-LUT[255] is calculated by (229/255) *255 and the Y-LUT[255] corresponds to 229.

Thus, the correction LUT 151 including relationship luminance signals Y, 0 through 255, in the reproducible range and the converted luminance signals Y-LUT[0] through Y-LUT[255] is completed.

Namely, the corrected luminance signal Y-LUT[y] is the value obtained by reducing a gradation of the luminance by the ratio of the peak luminance Ypeak to 255 (the maximum luminance level). However, it is not limited to the above method to obtain the corrected luminance signal Y-LUT[y]. The luminance can be reduced in the actual brightness of display panel 30 in view of an inverse Gamma feature of the display panel 30, or can be reduced by controlling a Gamma feature of an RGB signal in place of the luminance signal.

In step 6*i*, the picture correction function 150 selects one pixel in the picture frame to be processed. No same pixel is selected twice from one picture frame in the loop processing consisting of step 6*i* and step 6*j*.

The picture correction function 150 extracts the corrected luminance signal Y-LUT[Y(x,y)] corresponding to the luminance signal Y(x,y), which is designated by the coordinate (x,y), from the correction LUT 151, thereafter, outputs the corrected luminance signal Y-LUT[Y(x,y)] as luminance signal Y'(x,y) corresponding to the coordinate (x,y), and the processing goes to step 6*j*. Thus, the luminance signal Y(x,y) is converted into the corrected luminance signal Y-LUT[Y(x,y)]. Also, the picture correction function 150 outputs the luminance signals U(x,y) and V(x,y) together with the luminance signal Y'(x,y) to the display control unit 20.

In step 6*j*, the picture correction function 150 checks whether all pixels contained in the picture frame to be processed are processed according to the processing designated by step 6*i*. If all pixels in the frame are processed, Yes in step 6*j*, the processing is finished; however, if at least one pixel remains unprocessed, No in step 6*j*, then, the processing goes back to step 6*i* and the processing designated by step 6*i* is executed until all of the pixels are processed.

As described above, in the picture processing function 100, first, the value is obtained by multiplying the luminance signal by the weight coefficient corresponding to the chrominance signals for all pixels contained in the picture frame, then, the average value is calculated from the value, and finally, the peak luminance is determined based on the average value. Subsequently, the luminance signals are corrected based on the peak luminance.

Therefore, since the luminance signal is corrected in view of the chrominance signals on a frame to frame basis by the picture processing function 100, the electric power consumption of the self-luminous display panel can be cut according to the displayed scene without degradation of the sense of brightness.

In brief, the present invention is not limited to the above embodiments, and constituent elements can be variously modified and embodied at the execution stage within the spirit and scope of the invention. Various inventions can be formed by proper combinations of a plurality of constituent elements disclosed in the above embodiments. For example, several constituent elements may be omitted from the all the constituent elements in each embodiment. In addition, constituent elements of the different embodiments may be combined as needed.

Obviously, numerous modifications and variations of the present invention are possible in light of the above teachings. It is therefore to be understood that within the scope of the appended claims, the invention may be practiced otherwise than as specifically described herein.

What is claimed is:

1. A picture processing method of a picture frame including plural pixels, the method comprising:

receiving picture data including a luminance signal and chrominance signals for each pixel of a picture frame;

calculating, by a processor, a saturation value based on the chrominance signals;

obtaining a weight coefficient corresponding to the saturation value by referring to a weight coefficient storage;

calculating, by the processor, a first value by multiplying the luminance signal by the weight coefficient for the each pixel;

calculating, by the processor, a picture level value of the picture frame by using the first value;

converting the luminance signal included in the picture data based on the picture level value;

obtaining a peak luminance corresponding to the picture level value by referring to a gain storage;

wherein the converting converts the luminance signal included in the picture data based on the obtained peak luminance;

generating a conversion table based on the peak luminance so as to reduce a reproducible range of the luminance signal;

wherein the converting converts the luminance signal into the converted luminance signal by referring to the conversion table;

wherein the generating calculates the converted luminance signal by multiplying an input luminance by a result of dividing the peak luminance by a maximum luminance value, and generates the conversion table by relating the input luminance with the converted luminance signal.

2. The method according to claim 1, wherein the saturation value is obtained by calculating a square-root of the chrominance signals.

3. The method according to claim 1, wherein the weight coefficient storage stores the relationship between the saturation value and the weight coefficient such that the weight coefficient increases as the first value increases.

4. The method according to claim 1, wherein the calculating calculates the picture level value of the picture frame by averaging the first values.

5. A mobile communication apparatus comprising:

a receiving unit that receives broadcasting data;

a picture generation unit that generates picture data including a luminance signal and chrominance signals for each pixel of a picture frame; and a control unit that controls the mobile communication apparatus, wherein, the control unit:

calculates a saturation value based on the chrominance signals, obtains a weight coefficient corresponding to the saturation value by referring to a weight coefficient storage, calculates a first value by multiplying the luminance signal by the weight coefficient for the each pixel, calculates a picture level value of the picture frame by using the first value, and converts the luminance signal included in the picture data based on the picture level value;

wherein the control unit further obtains a peak luminance corresponding to the picture level value by referring to a gain storage, and the luminance signal included in the picture data is converted based on the obtained peak luminance;

wherein the control unit generates a conversion table based on the peak luminance so as to reduce a reproducible range of the luminance signal, and converts the luminance signal into the converted luminance signal by referring to the conversion table;

wherein the control unit calculates the converted luminance signal by multiplying an input luminance by a result of dividing the peak luminance by a maximum luminance value, and generates the conversion table by relating the input luminance with the converted luminance signal.

6. The mobile communication apparatus according to claim 5, wherein the saturation value is obtained by calculating a square-root of the chrominance signals.

7. The mobile communication apparatus according to claim 5, wherein the weight coefficient storage stores the relationship between the saturation value and the weight coefficient such that the weight coefficient increases as the first value increases.

8. The mobile communication apparatus according to claim 5, wherein the control unit calculates the picture level value of the picture frame by averaging the first values.

9. A mobile communication apparatus comprising:

a receiving unit that receives broadcasting data;

a picture generation unit that generates picture data including a luminance signal and chrominance signals for each pixel of a picture frame; and control means for controlling the mobile communication apparatus, wherein, the control means comprises:

means for calculating a saturation value based on the chrominance signals, means for obtaining a weight coefficient corresponding to the saturation value by referring to a weight coefficient storage, means for calculating a first value by multiplying the luminance signal by the weight coefficient for the each pixel, means for calculating a picture level value of the picture frame by using the first value; and means for converting the luminance signal included in the picture data based on the picture level value;

wherein the control means further comprises means for obtaining a peak luminance corresponding to the picture level value by referring to a gain storage, and the means for converting converts the luminance signal included in the picture data based on the obtained peak luminance;

wherein the control means further comprises means for generating a conversion table based on the peak luminance so as to reduce a reproducible range of the luminance signal, and for converting the luminance signal into the converted luminance signal by referring to the conversion table;

wherein the control means further comprises means for calculating the converted luminance signal by multiplying an input luminance by a result of dividing the peak luminance by a maximum luminance value, and for generating the conversion table by relating the input luminance with the converted luminance signal.

10. The mobile communication apparatus according to claim 9, wherein the saturation value is obtained by calculating a square-root of the chrominance signals.

11. The mobile communication apparatus according to claim 9, wherein the weight coefficient storage stores the relationship between the saturation value and the weight coefficient such that the weight coefficient increases as the first value increases.

12. The mobile communication apparatus according to claim 9, wherein the calculating means calculates the picture level value of the picture frame by averaging the first values.

* * * * *